US006098252A

United States Patent [19]

Woerth, Jr.

[11] Patent Number: 6,098,252

[45] Date of Patent: Aug. 8, 2000

[54] BELT BUCKLE WITH BACKLIFT FACE PLATES

[75] Inventor: Don E. Woerth, Jr., Rosenberg, Tex.

[73] Assignee: Victor M. Garcia, Guy, Tex.

[21] Appl. No.: 09/285,083

[22] Filed: Apr. 2, 1999

[51] Int. Cl.[7] ..... A44B 11/25; G09F 3/00

[52] U.S. Cl. ..... 24/163 R; 24/163 K

[58] Field of Search ..... 24/163 K, 163 R

[56] References Cited

U.S. PATENT DOCUMENTS

| | | | |
|---|---|---|---|
| 3,840,849 | 10/1974 | Lohr | 340/52 E |
| 3,969,836 | 7/1976 | DuBois | 24/163 K |
| 4,052,773 | 10/1977 | Nesbitt | 24/163 K |
| 4,384,390 | 5/1983 | Hayakawa | 24/163 R |
| 4,502,188 | 3/1985 | Kohli | 24/163 K |
| 4,570,308 | 2/1986 | Weisgerber | 24/163 K |
| 4,638,409 | 1/1987 | Berman | 362/104 |
| 5,379,493 | 1/1995 | Wu . | |

FOREIGN PATENT DOCUMENTS

| | | | |
|---|---|---|---|
| 2020539 | 11/1979 | United Kingdom | 24/163 K |

*Primary Examiner*—Victor N. Sakran
*Attorney, Agent, or Firm*—Randol Read

[57] ABSTRACT

A belt buckle used for advertising and novelty purposes includes a base frame which houses an electronic circuit for backlighting replaceable face plates that contain logos, slogans, or novelty designs, the electronic circuit provides an optional strobe effect, flashing the backlighting at an intermittent rate that draws attention to the logo, slogan, or design on the faceplate.

3 Claims, 2 Drawing Sheets

BELT BUCKLE WITH BACKLIFT FACE PLATES

BACKGROUND OF THE INVENTION

This invention relates to a belt buckle, specifically to a belt buckle for promotional and novelty use with a replaceable backlit face plate.

Wearable media such as belt buckles, buttons, T-shirts, baseball caps are commonly adorned with logos or slogans of favorite sports teams, popular companies and local events for promotional and novelty reasons. A disadvantage of these media is that the logo or slogan is fixed in the media and cannot be readily changed. A further disadvantage of these media is that they lack the ability to draw a potential target's attention to the logo or slogan.

U.S. Pat. Nos. 5,379,493 and 3,969,836, expressly incorporated herein, disclose belt buckles with replaceable ornamental face plates. That patent, however, relates to a belt buckle for purely ornamental purposes, and lacks backlighting that may draw attention to the faceplate.

It is therefore an object of the present invention to provide a belt buckle for promotional and novelty use with a face plate which may be readily replaced with another face plate bearing a different logo or slogan. It is a further objective of the present invention to provide backlighting for the face plate which flashes intermittently in order to draw attention to the displayed logo or slogan.

The belt buckle is designed using an injection molded plastic case with a removable end piece so that different face plates can be easily inserted into the belt buckle. When the face plate is in place, the end piece secures the face plate to the buckle.

It is a still further advantage that customized face plates can be fabricated at an extremely low cost and quick turnaround which promotes replacement of the face plates.

Other objects and advantages of the invention will become apparent to those skilled in the art during the course of the following detailed description.

DETAILED DESCRIPTION OF THE PREFERRED EMBODIMENT

Figure 1:
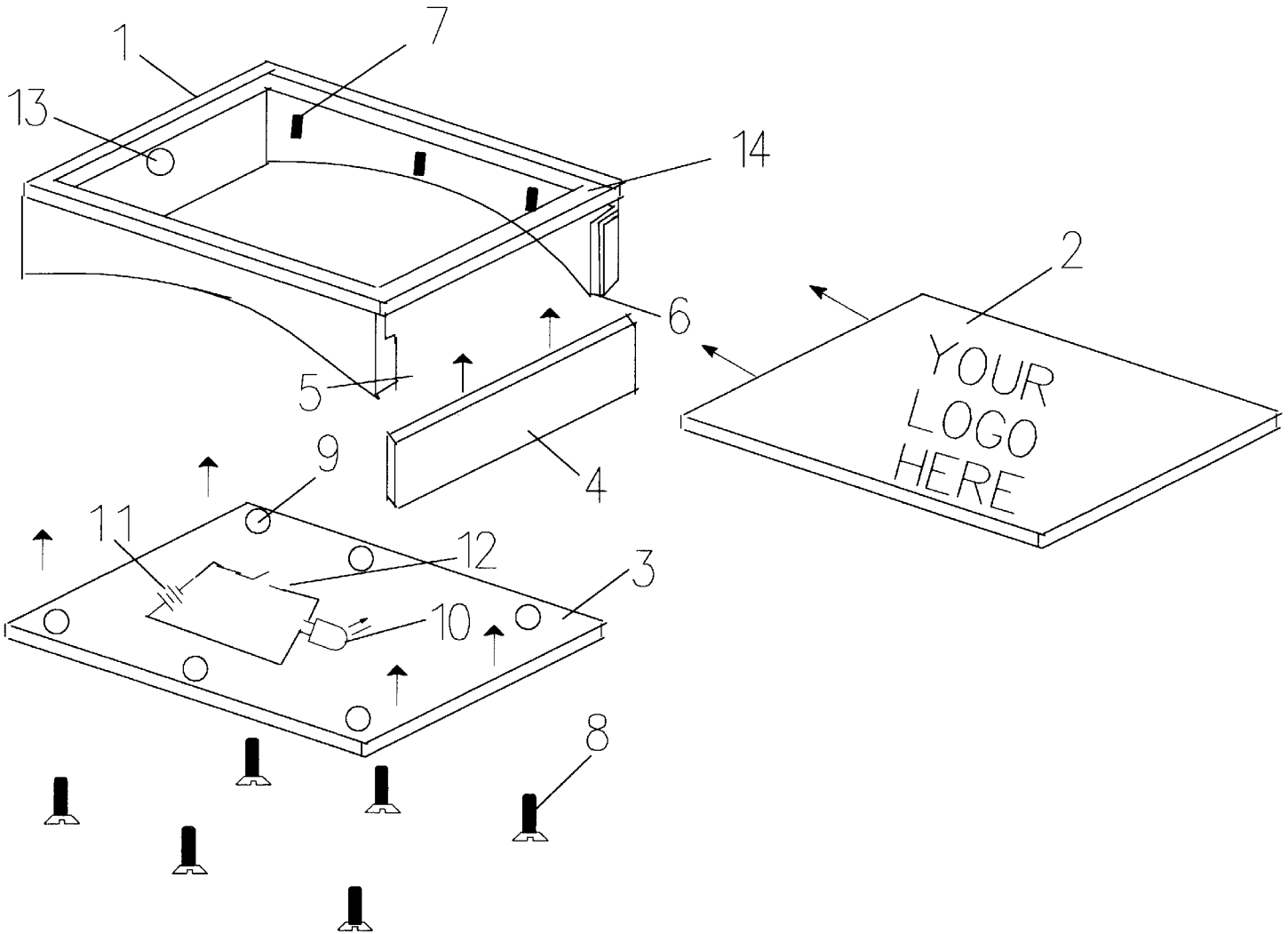
FIG. 1 is an assembly diagram of the present invention according to the preferred embodiment.

Referring to FIG. 1, a belt buckle in accordance with the present invention is generally comprised of an enclosure 1, a replaceable face plate 2, a printed circuit board 3 and a retaining piece 4. It is important that the face plate 2 be made of semi translucent material, such as plastic, so that the backlighting has a visible affect. Such custom face plates can readily be made using very low cost processes, with extremely quick turn around.

The enclosure 1 has an open top with a lip 14 around the entire outer edge, and an open end 5, with grooves 6 on the inside edges that accept the retaining piece 4. The enclosure 1 also has threaded inserts 7 along the inner sides perpendicular to the open end 5, to support the face plate 2 when it is inserted.

Printed circuit board 3 contains a light source 10, such as an LED or incandescent bulb, battery 11 and switch 12. The switch 12 is accessible through the opening 13 in the side of the enclosure 1, and allows the user to turn the backlighting on and off. Not shown is circuitry that allows the light source 10 to be strobed intermittently to draw attention to the face plate 2. The printed circuit board 3 is attached to the enclosure 1 with screws 8 inserted through mounting holes 9 into threaded inserts 7. It is critical that the printed circuit board 3 be long enough to secure retaining piece 4 in edge grooves 6 of open end 5 when the circuit board is secured to the enclosure 1. Not shown at the bottom of the printed circuit board 3 is hardware that accepts the ends of a belt.

The face plate 2 is secured to the top of the enclosure 1 when inserted into open end 5, in between threaded inserts 7 and the top lip 14. The face plate 2 is held in place at the open end 5 by the retaining piece 4 which is secured in edge grooves 6 of open end 5 when the printed circuit board 3 is attached to the enclosure 1.

The face plate 2 is removed by first removing mounting screws 8, then removing printed circuit board 3 which allows the retaining piece 4 to slide out of edge grooves 6 at the open end 5. Once the retaining piece 4 is removed, the face plate 2 can be removed from between the threaded inserts 7 and the top lip 14, out the open end 5. A new face plate may then be inserted and secured as described above.

ALTERNATIVE EMBODIMENT

Figure 2:
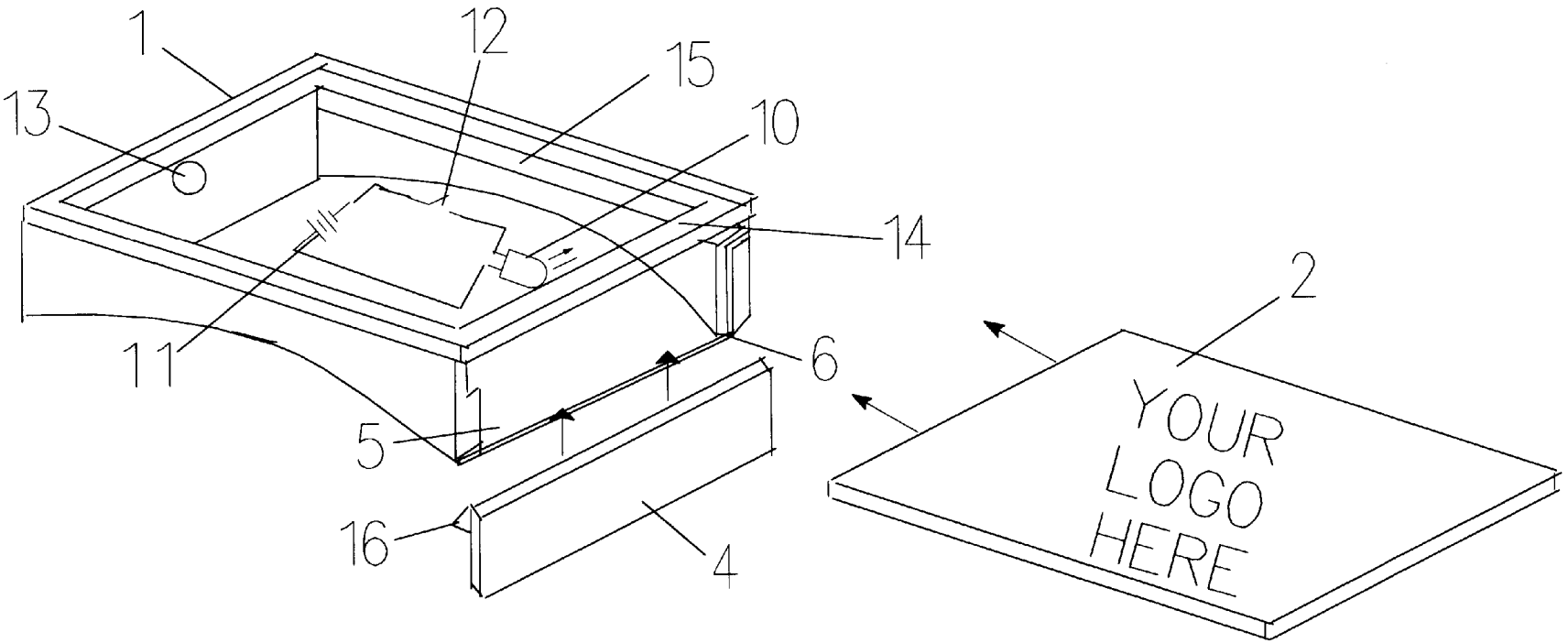
FIG. 2 is an assembly diagram of the present invention according to an alternative embodiment.

FIG. 2 shows an alternative embodiment of the present invention, with the backlighting circuit mounted in the bottom of the enclosure 1 rather than on a separate printed circuit board 3, as shown if FIG. 1. In this embodiment, the enclosure 1 has slide grooves 15 running the length of the inner sides perpendicular to the open end 5. The slide grooves 15 are defined on top by the top lip 14. Not shown at the bottom of the enclosure 1 is hardware that accepts the ends of a belt.

The face plate 2 is secured to the top of the enclosure 1 when slid into the slide grooves 15, and secured at the open end 5 by the retaining piece 4. The retaining piece 4 has a clip 16 at its top edge, that engages in the slide grooves 15 at the open end 5 when pushed to the top of edge grooves 6. The edge grooves 6 must be flexible enough to allow for the clip 16 to be slid up, while applying enough force to engage the clip 16 in slide grooves 15 when the retaining piece 4 is pushed all the way up. The retaining piece 4 must be slightly wider than the open end 5 of the enclosure 1, to allow for removal.

The face plate 2 is removed by first removing the retaining piece 4 by applying outward pressure to top of the retaining piece 4, disengaging the clip 16 from the slide grooves 15. The retaining piece 4 can then be removed by sliding it down the edge grooves 6. Once the retaining piece 4 is removed, the face plate 2 can be removed by sliding it through the slide grooves 15, out the open end 5.

While only two embodiments of the present invention has been shown and described, it will be understood that various modifications and changes could be made without departing from the spirit and scope of the invention.

I claim:

1. A belt buckle comprising:

a shallow rectangular enclosure, said enclosure having a bottom and an open top with a lip around the edges of said open top, with a small opening on one side;

a replaceable indicia-bearing face plate made of a semi-translucent material to allow for backlighting;

means for removing and securing said face plate to the top of said enclosure; and an electronic backlighting circuit for illuminating said face plate mounted in the bottom of said enclosure, comprising one or more light sources, circuitry for strobing said light sources intermittently, one or more batteries, and a switch for applying voltage of said batteries to said light sources, said switch being accessible through said opening on one side of said enclosure.

2. The belt buckle of claim 1, wherein:

said enclosure comprises a removable retaining piece, an open end with edge grooves to accept said retaining piece, and threaded inserts along its inner sides, perpendicular to said open end with said edge grooves;

the bottom of said enclosure is a printed circuit board containing said backlighting circuit and mounting holes, said printed circuit board being secured to said enclosure with mounting screws inserted through said mounting holes into said threaded inserts, securing said retaining piece to the enclosure; and said means for securing and removing said face plate to the top of said enclosure comprises said threaded inserts and said retaining piece, said face plate being secured to the top of said enclosure when resting on the top of said threaded inserts and held in place at the top by said lip around the top of said enclosure and held in place at the open end by said retaining piece, said face plate being removed by removing said mounting screws to remove said printed circuit which releases said retaining piece allowing the face plate to slide out of said open end.

3. The belt buckle of claim 1, wherein:

said enclosure comprises a removable retaining piece with a clip along its top edge, an open end with edge grooves to accept said retaining piece, and slide grooves along the length of its inner sides, said side grooves being defined on top by said lip of the enclosure, said slide grooves running perpendicular to said open end with said edge grooves, said retaining piece being secured when it is slid up said edge grooves until said clip engages with said slide grooves at the open end; and said means for securing and removing said face plate to the top of said enclosure comprises said slide grooves of the enclosure and said retaining piece, said face plate being secured to the top of said enclosure when resting on the top of said slide grooves and held in place at the top by said lip around the top of said enclosure and held in place at the grooved open end by said retaining piece, said face plate being removed by removing said retaining piece by applying outward pressure to the top of said retaining piece to disengage said clip from said slide grooves, allowing the face plate to slide out of said open end.

* * * * *